US008100435B1

(12) United States Patent
Arkwright

(10) Patent No.: US 8,100,435 B1
(45) Date of Patent: Jan. 24, 2012

(54) ADHESIVE FASTENER BINDER AND METHOD OF FILING A PAPER

(76) Inventor: George A. Arkwright, Alexandria, VA (US)

( * ) Notice: Subject to any disclaimer, the term of this patent is extended or adjusted under 35 U.S.C. 154(b) by 0 days.

(21) Appl. No.: 12/801,550

(22) Filed: Jun. 14, 2010

Related U.S. Application Data

(63) Continuation-in-part of application No. 11/395,311, filed on Apr. 3, 2006, now Pat. No. 7,735,872.

(51) Int. Cl.
*B42D 5/00* (2006.01)

(52) U.S. Cl. ..... 281/45; 281/21.1; 428/40.1

(58) Field of Classification Search ..... 281/5, 9, 281/10, 15.1, 21.1, 23, 38, 45, 48; 24/67 AR, 24/67 R; 283/81; 428/40.1, 354; 462/71, 462/75

See application file for complete search history.

(56) References Cited

U.S. PATENT DOCUMENTS

| | | | | |
|---|---|---|---|---|
| 2,277,318 | A | 3/1942 | Grant | |
| 4,650,706 | A | 3/1987 | Emmel | |
| 4,768,810 | A | 9/1988 | Mertens | |
| 4,822,074 | A | 4/1989 | Hueffman et al. | |
| 5,050,909 | A | 9/1991 | Mertens et al. | |
| 5,169,254 | A | 12/1992 | Arkwright | |
| 5,248,164 | A * | 9/1993 | Lepretre | 281/22 |
| 5,275,286 | A | 1/1994 | Bader | |
| 5,524,929 | A * | 6/1996 | Emmel et al. | 281/21.1 |
| 5,575,574 | A | 11/1996 | Mertens | |
| 6,153,278 | A | 11/2000 | Timmerman et al. | |
| 6,447,196 | B1 * | 9/2002 | Arkwright | 402/8 |
| 6,514,585 | B1 | 2/2003 | Pearson et al. | |
| 6,719,475 | B2 * | 4/2004 | Arkwright | 402/8 |

* cited by examiner

*Primary Examiner* — Dana Ross
*Assistant Examiner* — Pradeep C Battula
(74) *Attorney, Agent, or Firm* — Shlesinger, Arkwright & Garvey LLP

(57) ABSTRACT

A revised adhesive fastener pack, and its arrangement in a book-like ringless paper binder, enables inserted pages to be turned, and the immediate filing of a paper by eliminating a separate fastening and unfastening step.

9 Claims, 4 Drawing Sheets

ADHESIVE FASTENER BINDER AND METHOD OF FILING A PAPER

CROSS REFERENCE TO RELATED APPLICATIONS

This application is a continuation-in-part of U.S. patent application Ser. No. 11/395,311 filed Apr. 3, 2006, now U.S. Pat. No. 7,735,872, dated Jun. 15, 2010, which is incorporated herein by reference.

FIELD OF THE INVENTION

This invention relates to a new flat ringless binder for filing papers in a book-like format and where papers can instantly be inserted or removed, as an improvement over a conventional ring-binder.

OBJECTS AND SUMMARY OF THE INVENTION

A principal object of the invention is to provide a new paper ring binder type binder that does not require any preliminary steps before a paper can be secured or removed from the binder.

Another object of the invention is to provide a substitute for a retaining ring assembly in a binder that does not require papers that must be modified for the binder, such as punched holes and will immediately receive a paper.

A particular object of the invention is to provide an adhesive binder that is flat and permits immediate placement of a paper in the file, and removal of a paper by merely lifting it out of the binder.

A further object of the invention is to also provide a flat ringless paper binder that is compact and less costly as well as easier to use and carry.

Another object is to provide a simple, fasten on contact, book-type binder, where the inserted pages can be turned as pages in a book.

DETAILED DESCRIPTION OF THE INVENTION

Figure 1:
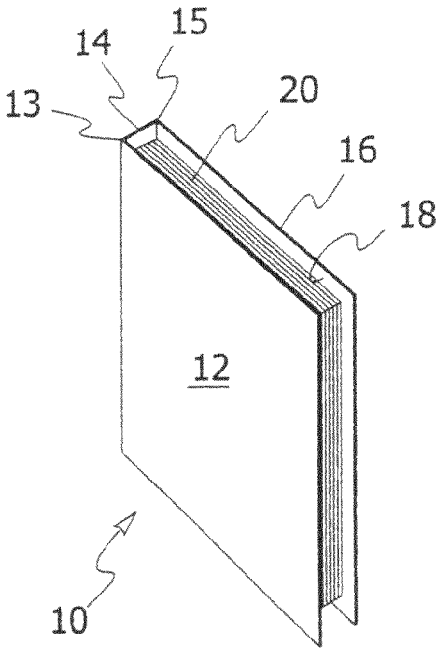
FIG. 1 is a perspective view of the flat ringless adhesive binder.

Referring particularly to the drawings, FIG. 1 is a perspective view of the closed flat ringless adhesive binder 10. The front cover panel 12 is a typical binder panel such as those used for ring binders.

A flexible bending line 13 connects the front cover panel 12 to a narrow connecting panel 14 which is slightly wider than the projected width of the binders contents. A second bending line 15 connects the other side of the narrow connecting panel 12 to the back mounting panel 16. This is the typical binder cover, but is unique because the narrow connecting panel 14 is substantially thinner than a ringbinder connecting panel. There is no need of extra width to accommodate the retaining rings of a ring binder.

The adhesive fasteners are paper-thin preferably polypropylene or similar flexible plastic material (about 2 mil), to provide the essential flexibility as well as being narrow and add less, therefore, to the width of the connecting panel.

The adhesive binder, unlike a PRIOR ART ring binder, is thinner, flat, and book-like and can be stacked and carried easily, in contrast to the generally triangular cross section of a PRIOR ART ring binder. However, the most useful feature of the binder is the ability to directly insert or remove a paper. This is the advantage of the adhesive fastener binder over the conventional ring binder. There is no need to open and close the rings and any paper can be filed. The paper does not have to be hole-punched. Additionally, papers held with adhesive fasteners will not tear out, as papers often do with papers filed in a ring binder. Also, a multi-page document is filed as a unit and held by the last page, so that it can be filed and removed as a single page.

Figure 2:
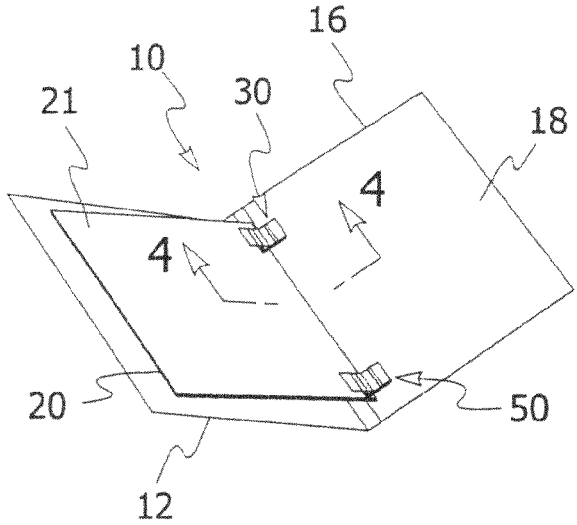
FIG. 2 is a plan view of the open binder, ready to accept a paper.

FIG. 2 shows the open adhesive fastener binder 10 opened and ready to accept a paper. The previously filed papers are opened like a book, and lay on the front cover panel 12. The back mounting panel 16, with the top adhesive fastener pack 30 and the lower adhesive fastener pack 50 are mounted on the inner surface 18 of the back mounting panel 16, are spaced for stability and better flexibility, are ready to receive a paper to be filed.

Figure 3:
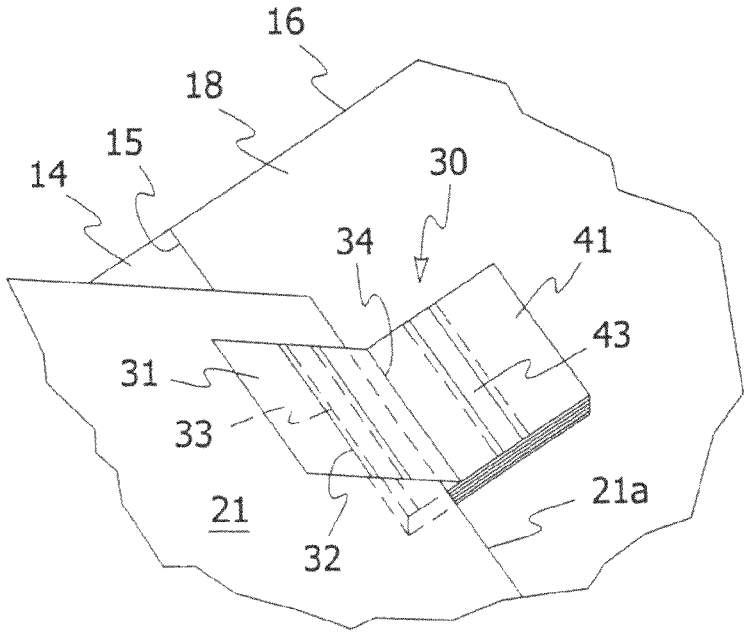
FIG. 3 is an exploded view of one of the adhesive fastener packs of FIG. 2.

FIG. 3 is an enlarged partial view of the open adhesive binder of FIG. 2. The adhesive fastener packs 30 and 50 are mounted on the mounting panel inner surface 18 next to the inner bending line 15, and are spaced to engage a filed paper about several inches from its top and from the bottom file paper edges. A single wider adhesive fastener pack mounted centrally could be used, but the two spaced and smaller width adhesive fastener packs provide more stability and flexibility.

The previously filed paper 21 is supported by narrow adhesive fastener 31 and its thin approximately one-eighth inch wide medium tack adhesive strip 33. The adhesive strip 33 can be either directly coated on the adhesive fastener or it can be an adhesive coated tape laminated to the adhesive fastener 31. The fastener 31 is a thin 2 mil polypropylene, polyethylene, or acetate narrow fastener piece, which is about one inch wide and one and a half inch long allowing for rotatable page-like mounting.

Figure 4:
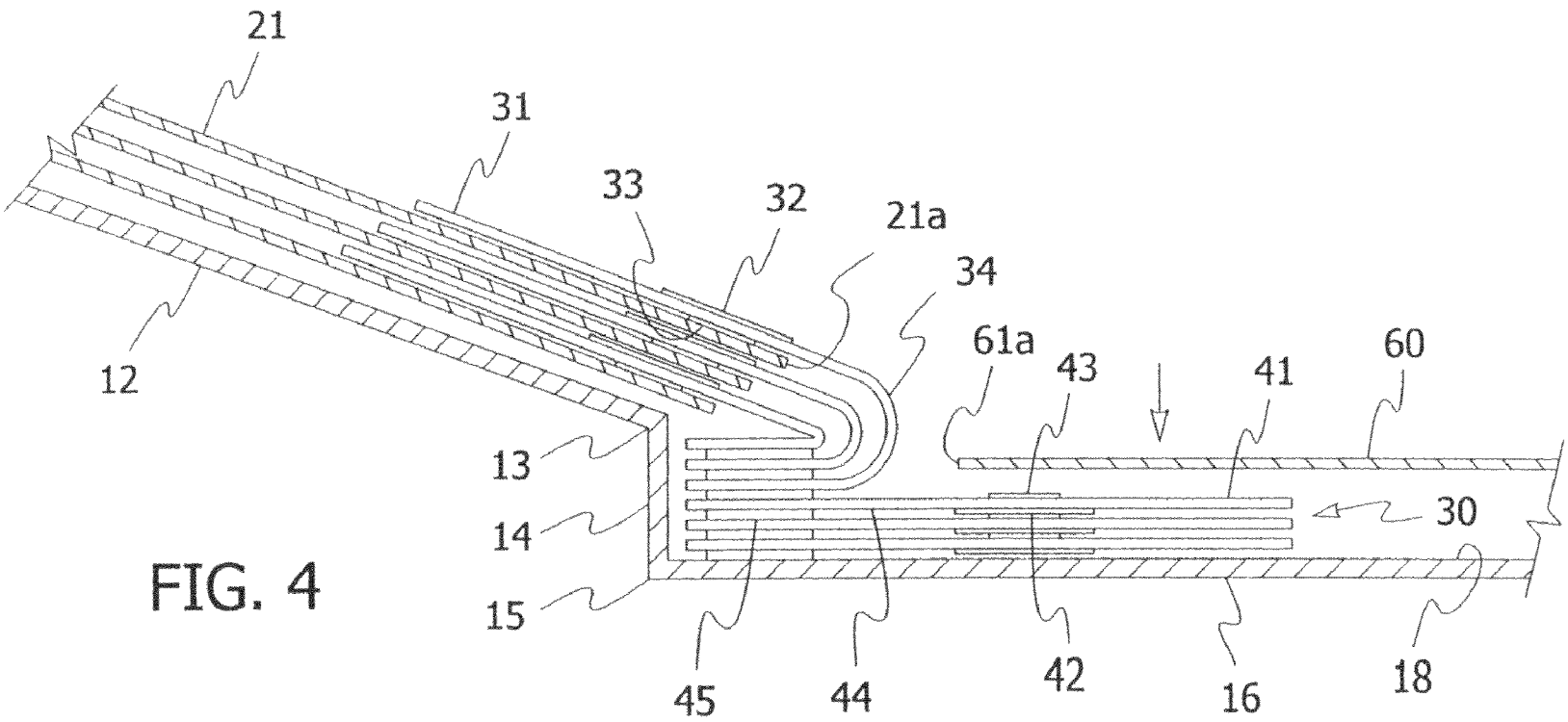
FIG. 4 is a sectional view along line 4-4 of FIG. 2, showing the position of the adhesive fasteners and their components as a paper sheet is added to the binder.

FIG. 4 is a cross section view along line 4-4 of FIG. 2 showing the connection of the adhesive strip 33 (about one-eigth inch wide) to the paper sheet 21. It also shows the alignment with the non-adhereable surface 32, such as silicone, which is disposed on the bottom of adhesive fastener 31. The non-adhereable surface as shown in FIGS. 3 and 4 is wider than the adhesive strip 32, with sufficient width (about three-eigths of an inch) to assure that it will align with and cover the adhesive strip 43 on the adhesive fastener 41 below it. All of the adhesive fasteners are identical, and are aligned and superposed.

The adhesive fastener packs 30 and 50 are the same. The adhesive fasteners are held together at their inner end by a double-sided permanent adhesive tape 45, preferably. The adhesive fastener 31, as shown in FIG. 4, has a bending section 34 that permits the attached pages to turn over to panel 12 easily in book-like fashion. It is approximately three-eighths although this can be varied for the side edge 21*a* of previously filed paper 21.

Referring to FIGS. 2 and 3, when the previously filed paper 21 is turned over to the front cover side of the binder, adhesive fastener 31, shown in FIG. 3, to receive another paper, adhesive fastener 31 is bent away from the next unattached adhesive fastener 41. And, the non-adhereable surface 33 separates from the thin medium tack adhesive strip 43.

The adhesive fastener binder 10, with the turning of previously filed page 21, is immediately ready to receive the next paper to be added. There is nothing left to do, but to place the next paper 60 on the back mounting panel inner surface 18, with the paper inner edge section on the exposed thin medium tack adhesive strips of the adhesive fastener packs 30 and 50.

This illustrates the recognition of this invention, unrealized heretofore, that in a ring binder assembly, rings were not necessary because with an adhesive fastener assembly the paper can also be filed in a book-like cover binder assembly.

Now the previously filed page could act to separate the fasteners, and also move the non-adhereable surface 32 away from its alignment and coverage of the thin medium tack adhesive strip 43, on the uppermost unattached adhesive fastener 41.

With the combining of placing the medium tack adhesive on the top surface of the adhesive fastener that will engage the next paper to be filed, and its covering by the non-adhereable surface on the adjacent paper-attached adhesive fastener above it, the action of moving of its attached paper will bend its fastener back and up to separate the two adhesive fasteners and simultaneously uncovers the medium tack adhesive, for engagement with the next paper to be filed, as shown in FIG. 4.

In this manner, both the need to separate the next fastener, to be used, and to remove a medium tack covering strip, are both accomplished with the turning of a page.

FIG. 4 shows the placement of the paper 60 on the adhesive fastener pack 30. Paper 60 is placed on the unattached adhesive fastener 41 for engagement with the uncovered medium tack (8-12 ounces) adhesive strip 43.

Preferably, a commercial coated tape is used. To assure adequate bending clearance, the inner edge 61*a* of placed paper 60 extends only slightly over the medium tack adhesive strip, and will not interfere with the bending section 44. The non-adherable surface 42 is aligned with, and is wider than, the medium tack adhesive strip 43.

Double-coated very high tack adhesive strips 45 hold the adhesive fasteners together. A similar strip holds the adhesive fastener packs in position on the inner surface 18 of the back mounting panel 16, adjacent to the second bending line 15 and the narrow connecting panel 14. Paper 60 after engaging the unattached adhesive fastener 41 of adhesive fastener pack 50, can be turned as a page in a book, and lie flat because of its short length binding section across the narrow adhesive fastener.

Figure 5:
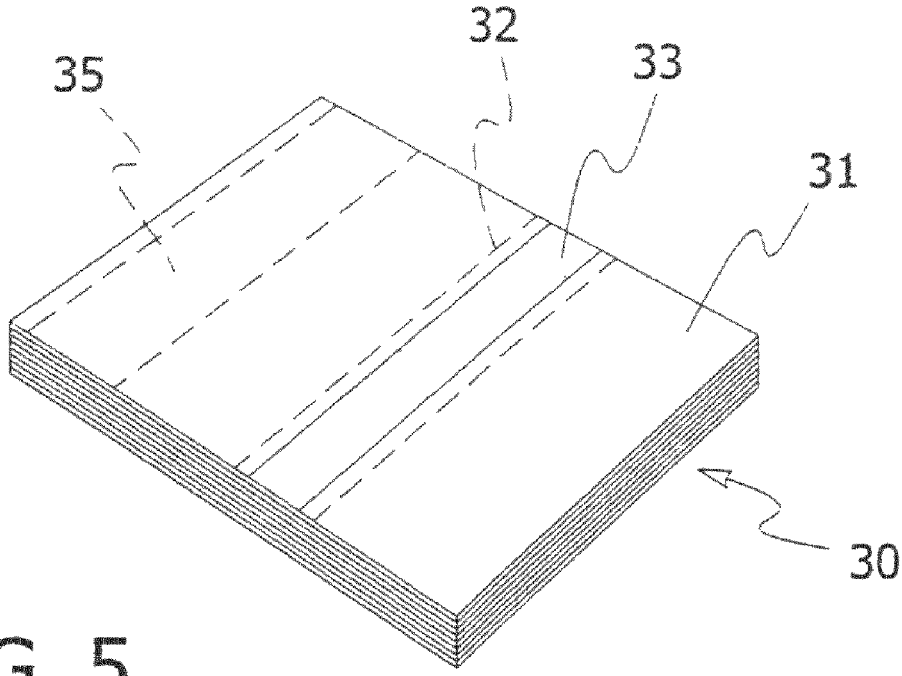
FIG. 5 is a top perspective view of an individual fastener pack such as fastener pack 30 of FIGS. 2 and 3.

FIG. 5 is a perspective view of the adhesive fastener pack 30, shown in FIG. 2, showing the thin medium tack adhesive strip 33 on the upper surface of adhesive fastener 31. The basic change from applicant's previous adhesive fastener embodiment(s) was the use of the previously filed paper to present the next unattached fastener of the adhesive fastener pack, and, make it ready to receive a paper immediately. The basic change in applicant's long-standing adhesive fastener embodiment(s) where the adhesive strip was placed on the under-side to now placing the adhesive strip on the adhesive fastener upper surface, coupled with the non-adhereable silicone coating on the adjacent adhesive fastener and, a narrower more flexible adhesive fastener provided a two panel pivoting, book-like page binding, led to the present development set forth herein.

Figure 6:
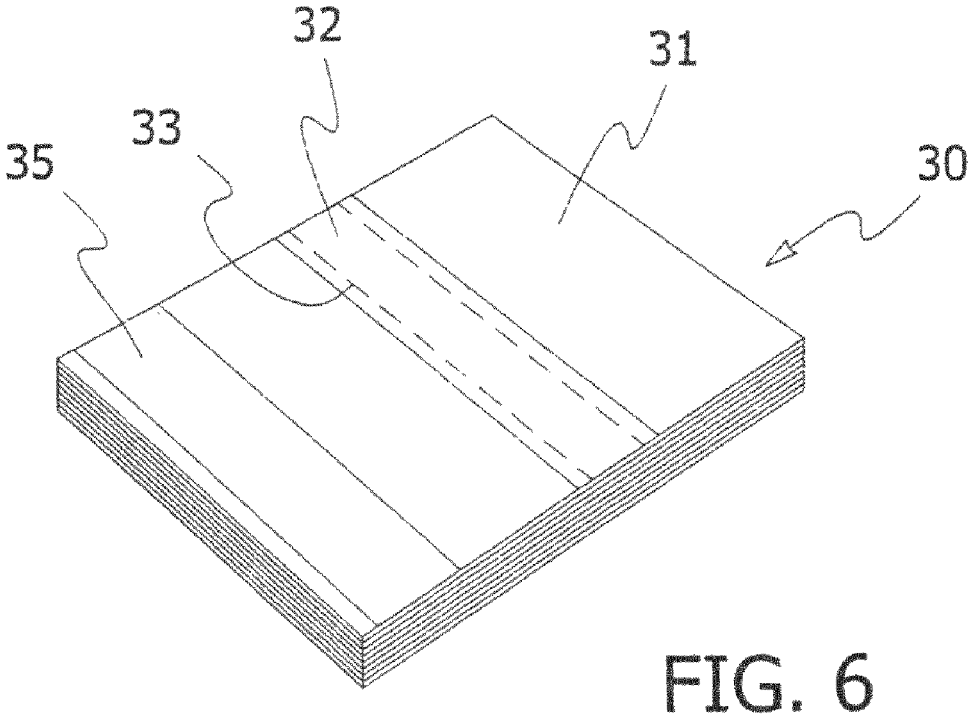
FIG. 6 is a bottom perspective view of the adhesive fastener pack of FIGS. 2 and 5.

FIG. 6 is a perspective view of the bottom of the adhesive fastener pack 30 of FIG. 2 showing the underside of the bottom adhesive fastener. As mentioned previously, all the adhesive fasteners are the same. The non-adhereable surface 32, and a double-coated permanent tack strip, which adheres to the inner surface 18 of the back mounting panel 16, are shown.

Figure 7:
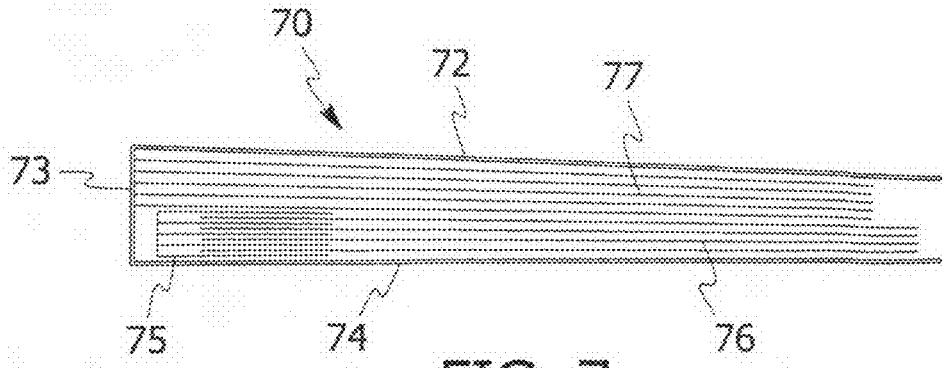
FIG. 7 is a cross-sectional view of the flat ringless adhesive binder, which has a notebook or textbook section.

FIG. 7 is a cross section of a further embodiment which is a modification of the previously described adhesive fastener binder. The combination notebook and adhesive fastener binder 70 has a front cover panel 72, a narrow connecting panel 73, and a back mounting page 74. The adhesive fastener pack 75, and filed papers 76, are the same as described above. The compact flat binder construction permits inclusion of a notebook section 77, the pages of which are bound and connected to the narrow connecting panel 73.

Figure 8:
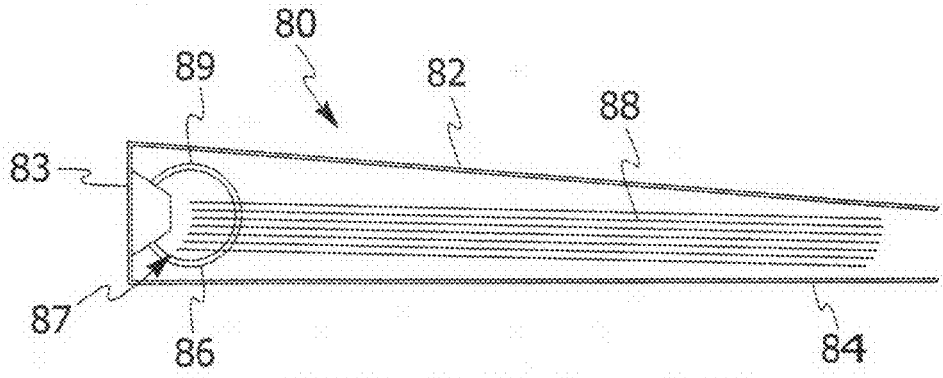
FIG. 8 (Prior Art)
FIG. 8 is a cross section of a conventional PRIOR ART ring-binder.

FIG. 8 is a cross section of a PRIOR ART ring binder, illustrating the sloped panel and triangular configuration. The PRIOR ART ring binder 80 has the conventional rigid front panel 82, narrow connecting panel 83, and rigid back panel 84. The metal ring 86 engages punched hole paper sheets 88. Note the lost space around the ring rear section 87, and the lost space in front of and behind the ring front portion 9. The adhesive binder according to the invention does not have these drawbacks. The substitution of a plain file folder modified adhesive fastener assembly is a new use for an adhesive fastener assembly modified for book-type pivotal page mounting.

Figure 9:
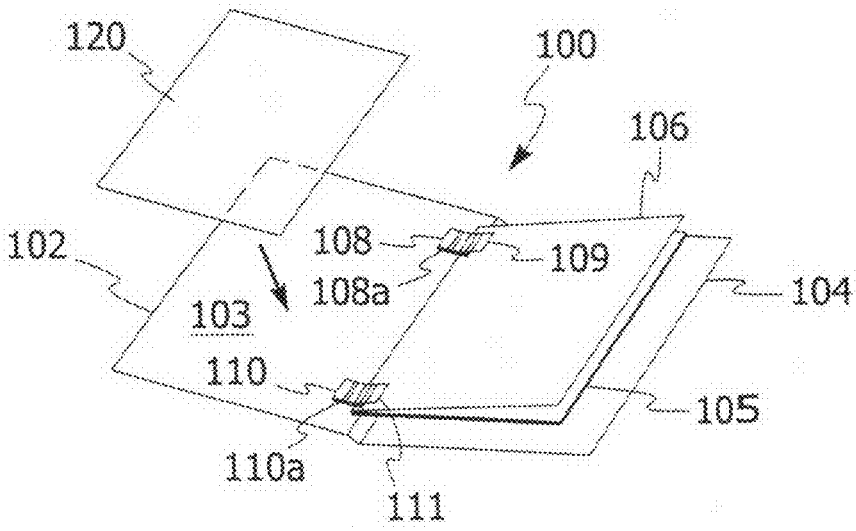
FIG. 9 is a perspective view of another flat ringless adhesive fastener binder configuration according to the invention.

FIG. 9 is a perspective view of a further embodiment showing a modification of the adhesive fastener binder of FIGS. 1-4, in which the papers were filed chronologically. This modification permits the most recently filed papers to precede prior filed papers.

The adhesive fastener binder 100 has a rigid front cover panel 102 which has an interior mounting surface and a rigid back panel 104, both flexibly connected to a narrow connecting panel, not shown. The cover panel construction is the same as that shown in FIGS. 1-4. Previously filed papers 105, and the recently filed paper 106 are connected to adhesive fasteners in adhesive fastener packs 108 and 110. The last filed paper 106 is held by adhesive fasteners 109 and 111. In the same manner as shown in FIGS. 2 and 3, binder 100 is opened, and page 106 is turned over, and the non-adhereable fasteners 109 and 111 uncover the thin medium tack strips 108*a* and 110*a*.

The paper 120 is then placed in position on the front cover panel inner surface 103 with its inner side edge aligned with and adhered to the thin medium tack adhesive strips 108*a* and 110*a* of the two top adhesive fasteners of the adhesive fastener packs 108 and 110.

A very significant and distinct feature of this invention is also the simple manner of removing any one of the filed papers. The paper is simply lifted out of the binder by lifting the top edge of the paper near the fastener to peel the paper off its two adhesive fasteners.

A paper that has been removed from the binder, is reinserted at its prior place in the binder in the same manner as a newly filed paper. To expose the thin medium tack adhesive strips for the returned paper, the mounting panel must be positioned as the bottom panel.

With respect to the fastener 31 of the invention, the free end section beyond the medium tack adhesive strip 32 provides some stability to aid in separation of the fasteners, and if necessary, a pull tab for release of the fastener from a paper in the file.

With respect to the binder cover, the cover panels are preferably rigid panels. But this invention also can be used in a unitary, flexible binder cover.

These and other advantages apparent from the foregoing description and drawings are considered etc.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A flat ringless instant file adhesive fastener book-type paper binder, comprising:

a) a binder cover having two opposed durable rectangular cover panels, each flexibly connected along a side edge line to a narrow connecting panel;

b) at least two spaced small adhesive fastener packs mounted on one of the panels adjacent to the side edge line at the narrow connecting panel, for fastening paper sheets;

c) each adhesive fastener pack having a plurality of superposed and aligned identical narrow adhesive fasteners held together at an inner end and attached to the one panel;

d) each fastener being a unitary narrow flexible thin about 2 mils plastic film which has a thin medium tack adhesive strip on its upper surface, which is parallel to and sufficiently spaced from the said inner end of the adhesive fastener to provide a fastener bending section which bends back over the inner end of the fastener to provide pivotal movement of a filed paper adhered to the adhesive strip allowing the filed paper to move as a book page from one cover panel to the other;

e) a non-adhereable surface disposed on the lower surface of the adhesive fastener which is in alignment with, and has a larger surface than the medium tack adhesive on the adhesive fastener upper surface; and f) the lower non-adhereable coating on each adhesive fastener being in non-adhering covering contact with the medium tack adhesive strip on the adhesive fastener below it, so that a file paper inner edge attached to the adhesive strip of an upper adhesive fastener will act to separate the upper adhesive fastener from the lower adhesive fastener, when the attached file paper is pivotably turned over to the other binder cover panel, to thereby uncover the medium tack adhesive on the lower fastener for receiving another file paper at its inner edge section.

2. The adhesive fastener ringless binder of claim 1, wherein:

a) the adhesive fastener is approximately one inch wide; and b) the medium tack adhesive is on a coated tape which is approximately an eighth inch wide, and extends across the width of the adhesive fastener.

3. The adhesive fastener ringless binder of claim 2, wherein:

a) the non-adhereable surface is on a coated tape which extends across the width of the adhesive fastener.

4. The adhesive fastener ringless binder of claim 3, wherein:

a) the adhesive fastener bending section is approximately three-eighths inch wide.

5. The adhesive fastener ringless binder of claim 4, wherein:

a) the two spaced adhesive fastener packs are mounted on the inside surface of the binder back cover mounting panel to engage the side edge of a file paper adjacent its top and bottom edges.

6. The adhesive fastener ringless binder of claim 5, wherein:

a) the two spaced adhesive fastener packs are mounted on the inside surface of a binder cover panel and each pack is placed to provide a balanced page-turnable mounting.

7. The adhesive fastener ringless binder of claim 1, wherein:

a) a book section of a plurality of edge-connected pages are disposed within and secured to the binder cover beside the adhesive fastener packs and secured to the narrow connecting panel.

8. The adhesive fastener ringless binder of claim 7, wherein:

a) the edge-connected pages are notebook pages.

9. Use of an adhesive fastener assembly in a durable cover insertable paper ring type file binder, where:

a) an adhesive fastener binder having opposed cover panels connected to a narrow connecting panel, one of the cover panels having at least two adhesive fastener packs mounted at the inside edge of one of the cover panels, and each having a plurality of superposed, identical, and aligned unitary construction narrow adhesive fasteners, which have a releaseable adhesive strip on their upper surface, inwardly spaced from the inner end of the fastener to provide an intermediate bending section, each adhesive strip being aligned with, and covered by a non-adhereable surface on the adjacent adhesive fastener;

b) where the adhesive fasteners permit a filed paper to turn over to the other cover panel the last filed paper attached to an adhesive fastener, so that the adhesive fastener to which the last filed paper is attached separates from its lower adjacent adhesive fastener to uncover the releaseable adhesive on the lower adjacent adhesive fastener, which is then ready to accept a paper; and c) a paper can be placed on the panel and over the releaseable adhesive with the paper side edge slightly overlapping the inner edge of the releasable adhesive, whereby the filed paper is also pivotably mounted to lie flat on either cover, and the paper can be removed by lifting it up from its spaced adhesive fasteners.

* * * * *